United States Patent [19]

Eckstein et al.

[11] 4,452,284

[45] Jun. 5, 1984

[54] PAPER MACHINE SCREEN AND PROCESS FOR PRODUCTION THEREOF

[75] Inventors: Konrad Eckstein, Pfullingen; Hermann Wandel, Reutlingen, both of Fed. Rep. of Germany

[73] Assignee: Hermann Wangner GmbH & Co. KG, Fed. Rep. of Germany

[21] Appl. No.: 187,895

[22] Filed: Sep. 17, 1980

Related U.S. Application Data

[63] Continuation of Ser. No. 932,224, Aug. 9, 1978.

[30] Foreign Application Priority Data

Aug. 16, 1977 [DE] Fed. Rep. of Germany ..... 2736796

[51] Int. Cl.[3] ..... D03D 3/04

[52] U.S. Cl. ..... 139/383 A; 139/426 R; 198/846; 162/348

[58] Field of Search ..... 139/383 R, 383 A, 420 R, 139/426; 428/257, 258, 259; 474/266, 267; 198/844, 846, 847; 162/348, DIG. 1

[56] References Cited

U.S. PATENT DOCUMENTS

| | | | |
|---|---|---|---|
| 2,145,786 | 1/1939 | Birkmeyer | 198/847 |
| 2,612,190 | 9/1952 | Hall | 139/383 A |
| 2,672,169 | 3/1954 | Walters | 139/383 A |
| 2,969,581 | 1/1961 | Bischoff | 139/383 A |

FOREIGN PATENT DOCUMENTS

| | | |
|---|---|---|
| 1697302 | 2/1955 | Fed. Rep. of Germany . |
| 1022089 | 1/1958 | Fed. Rep. of Germany . |
| 1160291 | 12/1963 | Fed. Rep. of Germany . |
| 1561679 | 3/1970 | Fed. Rep. of Germany . |

OTHER PUBLICATIONS

Sieb und Filz, 3rd edition, Karl Keim, p. 239, 1968.

*Primary Examiner*—Henry Jaudon

*Attorney, Agent, or Firm*—Sughrue, Mion, Zinn, Macpeak and Seas

[57] ABSTRACT

The longitudinal marginal regions of a synthetic fabric endless belt-type screen for a paper making machine are formed to permit less wear of the marginal regions due to greater elongation as compared to the central region.

6 Claims, 2 Drawing Figures

PAPER MACHINE SCREEN AND PROCESS FOR PRODUCTION THEREOF

This is a continuation of application Ser. No. 932,224, filed Aug. 9, 1978.

BACKGROUND OF THE INVENTION

Paper making machines employ endless belt-type screens upon which the paper is deposited. Normally, the paper is deposited in a substantially uniform layer in the center of the screen and the marginal regions on either side, up to about 50 cms wide, do not carry paper. The edge regions of the screen may be in abrading contact with the upper edges of suction boxes and the like which are used to withdraw water from the paper material or for other purposes.

From German application (AS) No. 1,022,089 it has been known to artifically elongate the marginal region of a screen relative to the center thereof and to set the screen fabric in this state. Although this measure increases the lifetime of a screen for a papermaking machine, the lifetime is nevertheless limited by the greater wear on the marginal regions of the screen.

From German application (OS) No. 1,561,679 it has been known to increase the lifetime of a screen for a papermaking machine by selecting a material of higher wear resistance for the longitudinal threads in the marginal regions. However, this publication exclusively relates to screens made from metal alloys.

Consequently, conventional papermachine screens are subject to higher wear in a marginal region of about 50 cm width than in the central region used for papermaking which will be briefly referred to as paper region. Furthermore, there is especially high wear at the format confining strips. The term "marginal region" as used herein shall include also the region of wear caused by the format confining strips and, in general, all regions subject to especially high wear. The exact cause for this greater wear of the marginal regions is unknown. However, it seems to be significant that the marginal regions run outside the suction box openings or on top of the margin of the suction box openings. Attempts have been made to prevent the higher wear of the marginal regions, for instance, by designing the openings of the suction boxes such that the lateral confinements extend obliquely with respect to the travel of the paper machine screen. However, these measures have been only partially successful.

SUMMARY OF THE INVENTION

The invention has as its object to provide a screen for papermaking machines which is not subject to higher wear in the marginal regions that it is in the papermaking region, and to provide a method for producing a screen for papermaking machines which has these properties.

A further object of the invention is a paper machine screen for a paper machine woven of longitudinal and transverse filaments comprising at least said longitudinal filaments being synthetic material capable of elongation under stress; said screen having a paper region and at least one marginal region between said paper region and a lateral edge of said screen; and the longitudinal filaments in said at least one marginal region having lower longitudinal stress when mounted and stressed for operation in said paper machine than the longitudinal filaments in said paper region.

A still further object of the invention is a process for making a paper machine screen comprising the steps of weaving said screen of weft strands and longitudinal warp strands; and tensioning said warp strands in a paper region at a higher stress than said wrap strands in at least one marginal region adjacent said paper region during said weaving.

DETAILED DESCRIPTION OF THE PREFERRED EMBODIMENT

Figure 1:
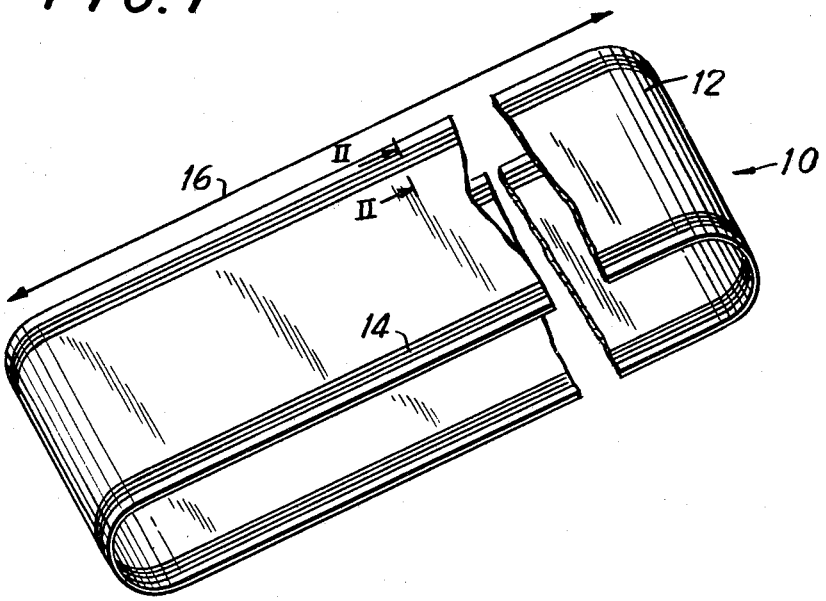
FIG. 1 is a perspective view of a paper machine screen according to an embodiment of the present invention.

Referring to FIG. 1, a paper machine screen 10 is shown according to the invention. The paper machine screen 10 includes a paper region 12 and marginal regions 14. Both regions preferably consist of synthetic resin wires, i.e. of monofilaments, but may also contain multifilament threads. It may be made in any weave, e.g. plain weave, twill and satin weave, and also in multilayer weaves. The marginal region 14 of the screen may contain longitudinal threads interwoven at different tension, longitudinal threads of various materials or of various diameters interwoven alternatingly or in any other sequence.

If another weave is used for the marginal region 14, namely a fewer-stranded weave, a greater volume is available for wear in the marginal region on account of the differently shaped warp and filling arcs.

The advantages attainable by the invention especially reside in the fact that the screen margin or the marginal regions 14 are more elastic than is the main or paper region 12 of the screen, and that the edge in the region of the suction box confinement (not shown) does not rise up and does not arch upwards, which is commonly designated as tunnelling.

In the papermaking machine a tension of about 100 N/cm (Newton/cm) is exerted on the screen 10 in the longitudinal direction 16 which stretches or elongates the screen 10. The elongation is substantially equal for the longitudinal threads in the paper region 12 and in the marginal region 14, but in the screen of the invention the longitudinal threads in the paper region 12 are maintained under higher tension than are the longitudinal threads in the marginal region 14 at a given elongation.

This may be explained also such that in the marginal region 14 the longitudinal threads undergo higher elongation at the screen tension occurring during use than do the longitudinal threads in the paper region 12, with equal length of the longitudinal threads in the marginal region 14 and in the paper region 12 of the screen 10. The elongation is determined such that strips of 1 cm width and equal length are cut from the paper region 12 and from the marginal region 14 and the increase in the strip length is determined by applying a force corresponding to the screen tension during use. Upon the exertion of a force of 100 N on strips of 1 cm width the elongation or increase in length of the strips cut from the marginal region is about 1.5 times that of the strips cut from the paper region. Such measurements are suitably made on strips of a certain width rather than on individual threads because with individual threads the measuring results are subject to excessive deviation and the measurement of strips will better reflect the condition prevailing during actual operation.

The higher extensibility of the longitudinal threads in the marginal region may be achieved, for example, in that there is a greater length of the starting thread within a given section of screen length, the longitudinal threads in the paper region and in the marginal regions having been identical prior to weaving, or that different longitudinal threads are used for the marginal regions, namely threads having a lower stress/strain quotient; generally polyester threads are used both in the paper region and in the marginal region, while the threads for the marginal regions have been given a greater elongation, e.g. by drawing to a lesser degree.

However, it is also possible to use longitudinal polyester threads in the paper region and polyamide threads in the marginal regions.

If the same threads are used both for the paper region and for the marginal regions, the paper machine screen of the invention may be produced by subjecting, during the manufacture of the screen, the longitudinal threads to lesser tension so that in the marginal region the warp tension is less if the screen is woven in ordinary weave. If the longitudinal threads are different in the paper region and in the marginal region, they may also be woven at equal tension.

The paper machine screens of the invention cannot be produced on conventional looms for ordinary weave screens if identical longitudinal threads are employed, because with the conventional looms all the warp threads are fed from a warp beam so that they are all under equal tension. Although it is possible to feed each individual warp thread from a bobbin creel, the threads then run about a tensioning device consisting of rolls extending across the entire width of the fabric so that they uniformly affect all threads. For the manufacture of the paper machine screens of the invention special bobbins or disks are provided beside the warp beam to feed the warp threads for the marginal regions.

Figure 2:
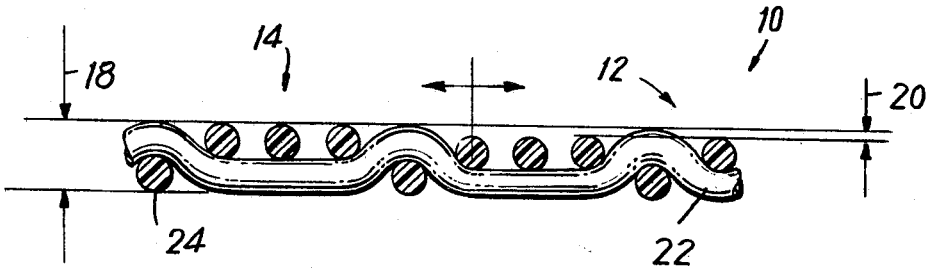
FIG. 2 is a transverse cross-section of a portion of a paper machine screen taken along II—II in FIG. 1.

Another problem arises from the circumstances that the marginal regions become thicker if the warp threads in these regions are supplied at lower tension, or if thicker warp threads are used in the marginal region. However, it has been surprisingly found that, upon setting of the papermaking screen by stretching, the marginal regions assume the same thickness as the paper region. When equal longitudinal threads are used, the marginal regions prior to setting are about 10 to 30% thicker than the paper region on account of the warp woven at lower tension. During stretching the marginal regions and the paper region first grew thinner. Since in the papermaking region the warp threads are woven under higher tension, the paper region reaches the monoplanar state earlier, i.e. the state when the bends of the weft threads on the warp side are disposed in the same plane as the warp threads, and vice versa. As seen in FIG. 2, upon continued stretching of the screen the warp or longitudinal threads 24 tend to lie in one plane so that the bends of the weft threads or transverse threads 22 rise over the warp threads, i.e. on the paper side of the weft threads 22 come to lie in a higher plane by an amount indicated by the arrows 20 than do the warp threads 24, so that the paper region 12 of the screen 10 grows thicker again. The marginal regions 14 reach the monoplanar state later since in these regions the warp threads 24 are woven more loosely. At a given screen stretching tension the marginal regions then have equal thickness indicated by the arrows 18 as the paper region. At this stretching tension the marginal regions 14 have not yet or have just reached the monoplanar state, while the paper region 12 is already past said state, i.e. it has exceeded the monoplanar state and has already become thicker again by an amount indicated by the arrows 20. The extra thickness defined by the arrows 20 just compensates for the extra thickness imparted to the marginal region 14 by the looser weaving or by the thicker filaments therein . In order to avoid marks in the paper it is essential that the marginal regions 14 and the paper region have equal thickness. This condition is fulfilled with the papermaking screen of the invention, which is surprising because the marginal regions 14 are markedly thicker after weaving but before stretching on a paper machine.

In special cases a thicker marginal region could offer advantages, the above described measures allowing precise predetermination of the thickness ratio between marginal region and paper region in the final screen.

Even if longitudinal threads having a lesser stress/-strain quotient are used for the marginal regions, these regions can be adjusted to the same thickness as the paper region because in that case, too, the marginal regions reach the monoplanar state later than does the paper region.

EXAMPLE 1

On a four stranded cross-twill screen having 28 longitudinal (warp) filaments/cm and 21 transverse (weft) filaments/cm (measured after setting) the marginal region was woven in the same material as the paper region, but with 30% less tension than in the paper region. The marginal web thickness was approximately 10 to 20% thicker than the web thickness of the paper region measured near it. At a stress which produced an elongation of 14% the web thickness in the marginal region and in the paper region were approximately equal. The stress/strain diagram for identical samples cut from the marginal and paper regions showed a greater elongation for the marginal region. At a tension of 100 N/cm, an elongation of 1.4% was measured in the sample from the paper region and an elongation of 2.3% was measured in the sample from the marginal region.

EXAMPLE 2

In a four stranded cross-twill screen having 31 longitudinal (warp) filaments/cm and 22 transverse (weft) filaments/cm (measured after setting) approximately 6.25% more longitudinal filament was woven into a marginal region using the same material as in the paper region. According to the stress/strain diagram on identical samples cut from the screen the marginal elongation was greater than the elongation of the paper region measured at a stress of 120 N/cm. Measured at a stress of 400 N/cm, the elongation of the sample from the paper region amounted to 5.4%, while the elongation of the sample from the marginal region was 7.4%.

EXAMPLE 3

A four stranded cross-twill screen having approximately 32 longitudinal (warp) filaments/cm and 21 transverse (weft) filaments/cm, (measured after setting) was woven using longitudinal strands at its margin made of different material and with approximately 3.7% more longitudinal filament woven in. According to the stress/strain diagram the elongation values for the individual filaments of the marginal region were greater than for those of the paper region by over 50%.

It will be understood that the claims are intended to cover all changes and modifications of the preferred embodiments of the invention, herein chosen for the purpose of illustration which do not constitute departures from the spirit and scope of the invention.

What is claimed:

1. A paper machine screen for the wet paper processing end section of a paper machine woven of longitudinal and transverse synthetic filaments, comprising:

(a) at least said longitudinal filaments being of a synthetic material capable of elongation under stress;

(b) said screen having a paper region, and at least one marginal region between said paper region and a lateral edge of said screen;

(c) the longitudinal filaments in said at least one marginal region having a longitudinal elastic elongation which is about 50% greater than that of the longitudinal filaments in said paper region measured at a stress of 100 N/cm and based on equal lengths of longitudinal threads in the marginal region and longitudinal threads in the paper region of the screen; and (d) said longitudinal filaments in said at least one marginal region having a thickness different from that of the longitudinal filaments in the paper region.

2. A paper machine screen according to claim 1, wherein the transverse filaments in the paper region at the paper side are disposed in a higher plane than the longitudinal filaments, and the longitudinal filaments and the transverse filaments in the marginal region are disposed in approximately one plane.

3. A paper machine screen for the wet paper processing end section of a paper machine woven of longitudinal and transverse synthetic filaments, comprising:

(a) at least said longitudinal filaments being of a synthetic material capable of elongation under stress;

(b) said screen having a paper region and at least one marginal region between said paper region and a lateral edge of said screen;

(c) the longitudinal filaments in said at least one marginal region having a longitudinal elastic elongation which is about 50% greater than that of the longitudinal filaments in said paper region measured at a stress of 100 N/cm and based on equal lengths of longitudinal threads in the marginal region and longitudinal threads in the paper region of the screen; and (d) said longitudinal filaments in said paper region consisting of a first material, and said longitudinal filaments in said at least one marginal region consisting of a different material more capable of elongation.

4. A paper machine screen according to claim 3, wherein said first material is polyester and said different material is polyamide.

5. A paper machine screen according to claim 3, wherein the transverse filaments in the paper region at the paper side are disposed in a higher plane than the longitudinal filaments, and the longitudinal filaments and the transverse filaments in the marginal region are disposed in approximately one plane.

6. A paper machine screen according to claim 5, wherein the transverse filaments in the paper region at the paper side are disposed in a higher plane than the longitudinal filaments, and the longitudinal filaments and the transverse filaments in the marginal region are disposed in approximately one plane.

* * * * *